US005306124A

United States Patent [19]

Back

[11] Patent Number: 5,306,124

[45] Date of Patent: Apr. 26, 1994

[54] SLURRY PUMP AND SEAL SYSTEM

[75] Inventor: Carl F. Back, Winter Haven, Fla.

[73] Assignee: Laibe Supply Corporation, Indianapolis, Ind.

[21] Appl. No.: 36,662

[22] Filed: Mar. 24, 1993

[51] Int. Cl.[5] ..... F04B 17/00

[52] U.S. Cl. ..... 417/406

[58] Field of Search ..... 417/407, 409, 406, 371

[56] References Cited

U.S. PATENT DOCUMENTS

| | | | |
|---|---|---|---|
| 2,149,600 | 3/1939 | Guinard | 417/406 |
| 2,766,695 | 10/1956 | Gailloud . | |
| 3,761,205 | 9/1973 | Cronstedt . | |
| 3,890,065 | 6/1975 | Ellen et al. | 417/407 |
| 4,272,224 | 6/1981 | Kabele . | |

*Primary Examiner*—Richard E. Gluck
*Attorney, Agent, or Firm*—Woodard, Emhardt, Naughton, Moriarty & McNett

[57] ABSTRACT

A mud pump assembly has a housing having a motor-mounting face directly connected to a standard hydraulic drive motor. The pump housing supports and partially encloses a bearing assembly which supports the pump impeller shaft. A face-type impeller shaft seal is located between the bearing assembly and the impeller. The motor case completes enclosure of the impeller shaft bearing assembly. A motor case drain line is coupled to the mud pump housing for continuous pressure lubrication of the bearing assembly. In one embodiment, case drain fluid is returned from the mud pump housing to the hydraulic fluid reservoir for the hydraulic motor.

13 Claims, 4 Drawing Sheets

SLURRY PUMP AND SEAL SYSTEM

BACKGROUND OF THE INVENTION

1. Field of the Invention

This invention relates generally to mud pumps for use in water well drilling operations, and more particularly to a motor driven centrifugal-type mud pump assembly having a close-coupled direct drive hydraulic motor and a case-drain-pressurized pump shaft seal assembly at the mud pump impeller end of the shaft.

2. Description of the Prior Art

During water well drilling operations, it is usually necessary to pump muddy water. Though some pumps are of a reciprocating type, most pumps used for this purpose are rotary pumps, primarily because they are much less expensive than reciprocating pumps. One problem that is very common with rotary pumps is seal failure due to the abrasives in the mud being pumped.

Many mud pumps are driven by a hydraulic motor through a coupling shaft assembly such that the motor is spaced sufficiently from the pump for access to a pump shaft seal packing housing to facilitate replacement of seals. Depending upon the manner and environment of use of the pump, seal failures can occur as often as daily, resulting in significant down-time during replacement of a seal assembly. In addition, due to the necessity of having enough space to change a seal, the pump and drive motor assembly has an overall length that is objectionable.

Since the pump impeller has a high rotational speed, and must be supported in the housing by suitable bearings, leakage of muddy water into the bearing area is intolerable. At one time, asbestos was used as a component of pump shaft seal packing. Health and environmental concerns have since dictated the exclusion of asbestos from such materials, resulting in a reduction in the packing life.

As is true of many mechanical devices, provisions are typically made for greasing pump bearings by using a grease gun. But this requires regular attention by an operator to be certain that greasing is done on a timely and adequate basis. Also, it is important to avoid excessive pressure such as could cause the blow-out of a shaft seal.

It is an object of the present invention to provide a mud pump shaft sealing system facilitating close coupling of the pump and drive motor, and providing comparatively long seal life.

SUMMARY OF THE INVENTION

Described briefly, according to a typical embodiment of the present invention, a mud pump assembly is provided with a housing having a motor-mounting face directly connected to a standard hydraulic drive motor. The pump housing has a bearing receiving cavity therein which contains a bearing assembly to support the pump impeller shaft and a face-type shaft seal assembly between the bearing assembly and the impeller. The motor case drain line is coupled to the bearing cavity in the pump housing for continuous pressure lubrication of the impeller shaft bearings and the seal assembly.

DESCRIPTION OF THE PREFERRED EMBODIMENT

Figure 1:
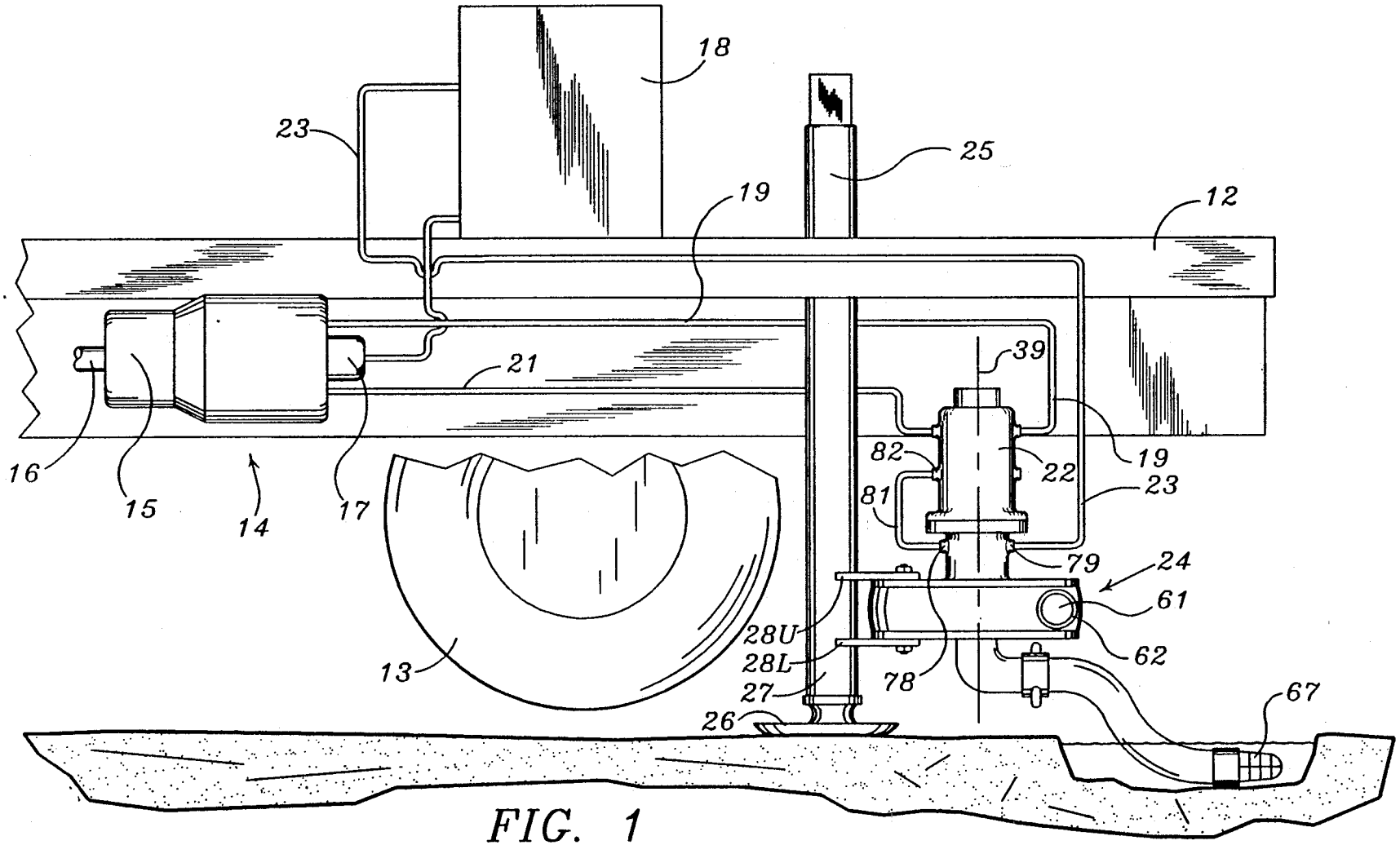
FIG. 1 is a fragmentary elevational view of a mobile drilling rig showing a pump and motor assembly in position for pumping mud from a shallow pit.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 shows fragmentarily a portion of the rear of a truck having a bed 12 supported on frame side members supported on dual wheels 13. A hydraulic pump assembly 14 mounted to the truck includes a fixed displacement pump 15 and a charge pump 16, both of which are driven by an input drive shaft 17 from a power take-off or transfer case from the truck engine (not shown). The charge pump 16 takes hydraulic fluid from the supply reservoir 18 and delivers it to the pump 15 for delivery under pressure and return through one or the other of the lines 19 and 21 coupled from the hydraulic pump 15 to the hydraulic motor 22. A motor case drain line 23 is returned, typically through the hydraulic pump housing, to the reservoir 18 but shown directly returned in FIG. 1. The determination of whether high or low pressure oil is in one or the other lines 19 and 21 is typically controlled by a conventional pump control system, this being a conventional type of hydrostatic transmission or drive system employing a fixed displacement hydraulic motor 22 and fixed displacement hydraulic pump 15 such as are well known in the art.

The mud pump assembly 24 is near the rear end of the truck. A hydraulic truck-stabilizing jack assembly includes a housing 25 fixed to the truck frame. A cylinder and piston rod assembly is located in the housing 25, with the rod end up so that the foot 26 of the jack assembly is swivel mounted to the bottom of the cylinder in conventional manner. An upwardly-opening cylinder 27 is fastened to the foot and is vertically slidable along the outside of the jack housing 25 as the jack is extended and retracted. The mud pump is preferably mounted by means of upper and lower brackets 28U and 28L, respectively, fastened to the cylinder 27 on the foot of the left rear jack assembly so that, when the jack is extended so that its foot 26 bears on the ground, the mud pump housing is near or at ground level. These features are shown schematically in FIG. 1, as their precise location on the truck frame may be varied, depending upon the particular configuration of the truck, stabilizing jacks, and other features. The jack mounting shafts may be driven by hydraulic power or manually or otherwise, as desired. Also, the pump may be mounted on the right rear jack foot or at another location on the truck, and the orientation of the pump axis may be different from vertical, if desired.

Figure 2:
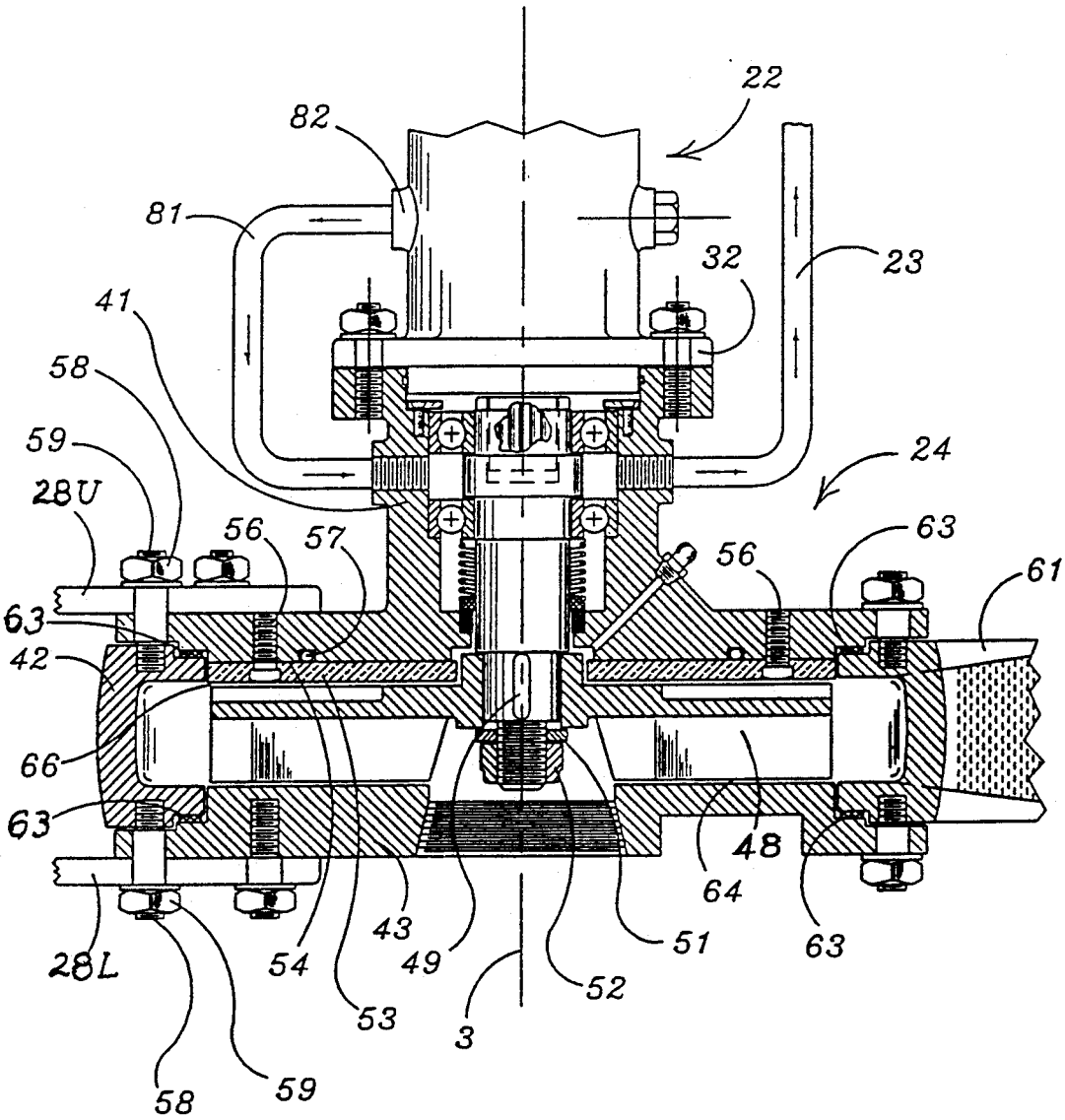
FIG. 2 is an enlarged fragmentary sectional view through the motor and pump assembly showing internal details of the pump assembly.
Figure 3:
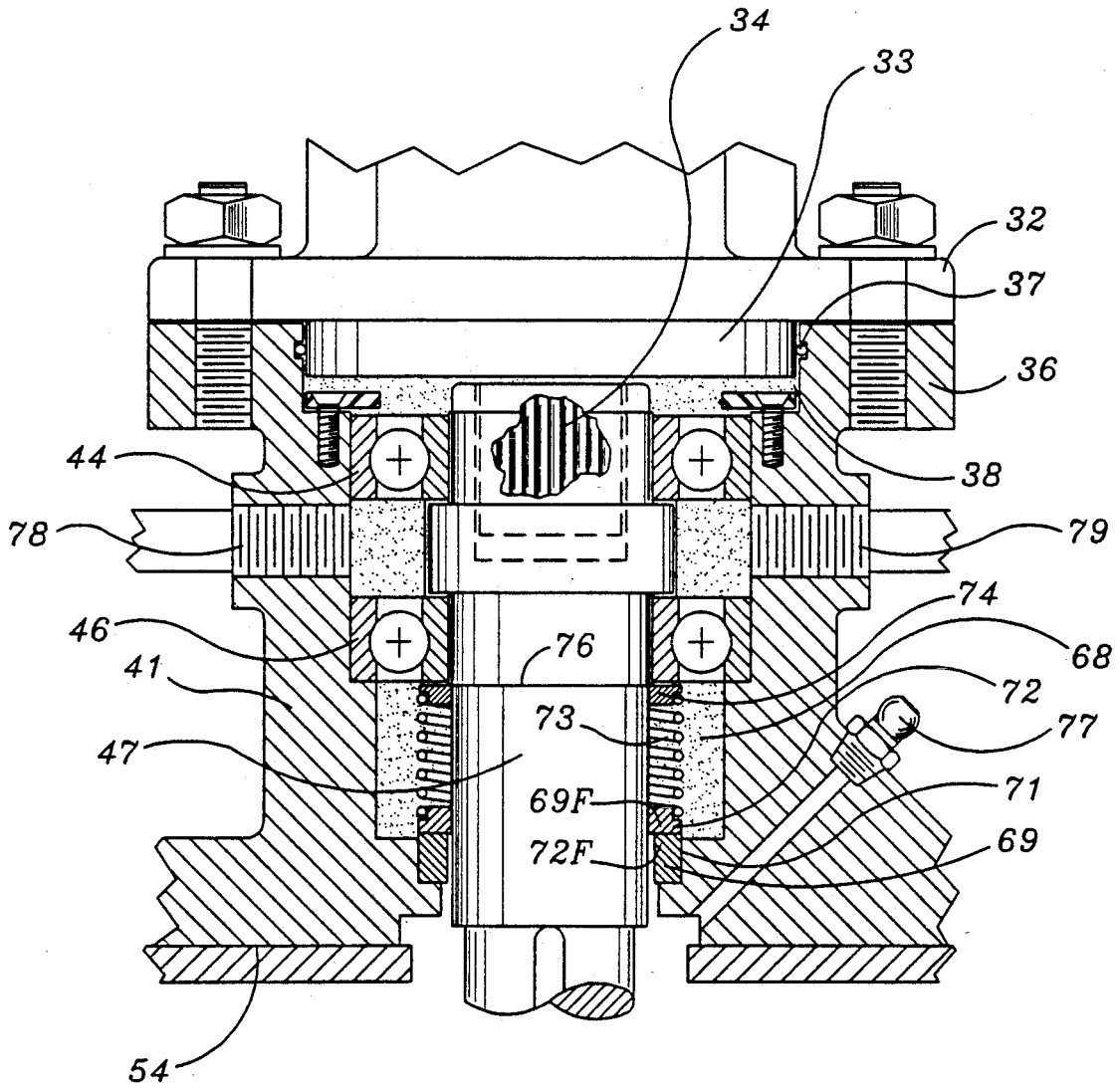
FIG. 3 is a further enlarged fragmentary view showing the mounting of the seal assembly.

According to one feature of the invention, the mud pump is close-coupled to the hydraulic motor. In the illustrated embodiment, the mud pump housing is bolted directly to the hydraulic motor case. Referring now specifically to FIG. 2, the hydraulic motor 22 can be any of a variety of conventional off-the-shelf hydraulic motors readily available from manufacturers and having a conventional mounting flange 32 with pilot flange 33 and splined output shaft 34 with a 12–24 pitch spline, 14 teeth, for example. An example is the 21 Series Motor by Sundstrand of Ames, Iowa, U.S.A. Thus, one feature of the pump assembly of this invention is the fact that its mounting flange 36 bolts directly to the mounting flange 32 of the hydraulic motor. An O-ring seal 37 is provided at the interface between the pilot flange 33 of the motor and the pilot cavity wall 38 of the pump housing assembly.

There are three major components of the pump housing assembly, namely the bearing housing 41, center housing 42, and cover plate 43. Upper and lower ball bearing assemblies 44 and 46 are received in a bearing cavity in the bearing housing to support the impeller shaft 47, having an internal spline received on the motor shaft spline 34. The impeller 48 is keyed at 49 near the lower, impeller-mounting end of the shaft, and secured by a washer 51 and nut 52 at the lower end of the mud pump shaft. A replaceable back plate 53 is fastened to the face 54 of the bearing housing by circularly spaced socket head cap screws 56, with an O-ring interface seal 57 employed, if desired.

The center housing 42 is secured to the bearing housing by twelve circularly-spaced bolts or stud-nut combi7 nations. Three of the bolts, or stud-nut combinations 58,59 are use to fasten the upper bracket 28U to the bearing housing as well as the bearing housing to the center housing. The mud pump discharge outlet 61 is at the perimeter of the center housing, and internally threaded to receive discharge pipe 62 (FIG. 1). Paper gaskets 63 are employed between the center housing and the cover plate 43 and bearing housing 41 to provide a seal at each of these locations. The gaskets between the cover plate 43 and center housing 42 can be selected to provide the desired axial clearance space 64 between lower edges of the impeller blades and the upper face of the cover plate. At the upper face of the impeller, the clearance 66 can be controlled by the thickness of the plate 53 that is installed. The pump inlet is at the center of the cover plate 43 and is internally threaded to receive an inlet pipe fitting. In the illustrated example with the pump near ground level, a street elbow is mounted in the inlet and connected to an intake hose whose inlet is connected to a foot valve 67 submerged in the mud pit. Thus, the pump remains primed. In any case, priming is easy.

Another feature of this invention is the use of the face seal assembly 68 in the bearing housing. This seal assembly includes a ring 69 which is snugly and sealingly received in the step bore 71 in the bearing housing. It does not rotate in the bearing housing. A spring biased seal ring 72 is slidably but sealingly fitted to the shaft 47 and is biased by the coil spring 73 to abuttingly engage and seal the lower face of seal ring 72 against the upper face of the seal ring 69. A spring seat collar 74 on shaft 47 abuts the shaft shoulder 76 and serves as a pilot and seat for the spring 73 at the upper end of the spring. It is intended that the spring seat collar 74, spring 73 and seal ring 72 turn with the shaft. Therefore, both of the seal rings 72 and 69 need to have good wearing and sealing surfaces. An example of a low friction, wear resistant material for ring 72 is sold under the trade name "Rulon A" by Dixon Industries, Inc. of Clifton Heights, Pa. A glass filled "Teflon" can also be used for this ring. The flat face 72F of this ring provides a running seal against the flat face of the seal ring 69 which should have a hard, wear resistant flat face 69F. Tungsten carbide may be a suitable material for the face 69F of the seal ring 69. A seal assembly which will work is made by the E.G. & G. Sealol Incorporated of 455 West Fullerton, Elmhurst, Ill.

A grease fitting 77 is installed in the bearing housing as shown, at the top of a passageway leading to the space between the impeller and the seal assembly. This enables application of grease on a regular basis to the pump housing assembly below the seal assembly at the impeller hub. Even so, another feature of the present invention is the use of hydraulic fluid at the motor case drain pressure to lubricate the pump bearings. For this purpose, two threaded ports 78 and 79 are provided in the pump housing. A hydraulic fluid line 81 is connected by a suitable threaded fitting into port 78 of the pump housing and to the normal case drain port 82 of the hydraulic motor 22. A case drain fluid return line 23 is connected to the port 79 of the pump housing and returned to the reservoir 18. The motor case drain fluid line 23 is shown connected through the pump housing where it co-mingles with any case drain fluid in the pump housing and from which it is returned directly or through a heat exchanger to the reservoir 18. Of course, line 23 could be connected directly to the reservoir 18, if desired.

As can be seen in the drawing FIG. 2, this arrangement enables the direct application of the hydraulic fluid from the hydraulic motor at case drain pressure to both of the ball bearing assemblies. The pressure is also applied directly to the seal assembly.

The loading of spring 73 is established to require at least a 15 psi pressure drop from the impeller side to the bearing side of the seal assembly 68 for the seal to open.

In operation, with the mud pump drive motor at rest, the mud pump might or might not be primed. In either case, there would be a spring load on the bearing seal assembly, 10 pounds, for example. Therefore, the seal would remain sealed regardless of temperature and regardless of whether or not the pump is primed. During start-up and, if the pump is not primed (which is the usual condition), rotation of the impeller may establish a vacuum at the impeller side of the seal assembly. While such a vacuum might normally pull the packing away from a conventional pump bearing seal, that will not happen with the seal assembly of the present invention. The vacuum would tend to close the seal. The spring 73 will assure that it is closed. In addition, hydraulic fluid in the hydraulic pump 15 will soon cause a rise in pressure in the case drain line which may rise to a point anywhere from 10 to 45 psi, depending upon the nature and condition of the hydraulic pump itself, and the resistance in the line 81 to the bearing assembly, and from the bearing assembly through line 23 to the hydraulic pump and from there to the reservoir 18. Therefore, there is normally a pressure drop across the seal assembly from the bearing side to the impeller side during all mud pump operating pressure conditions which could range from zero to 10 to 15 psi output pressure.

Another factor contributing to maintenance of the closed condition of the seal assembly is the fact that the area of the seal ring 72 exposed to the impeller pressure is about half the area thereof exposed to the case drain fluid pressure. Therefore, for a given amount of hydraulic pressure applied to each side of the seal ring 72, the force in the closing direction, i.e. toward impeller, is at least twice that in the opposite direction.

Figure 4:
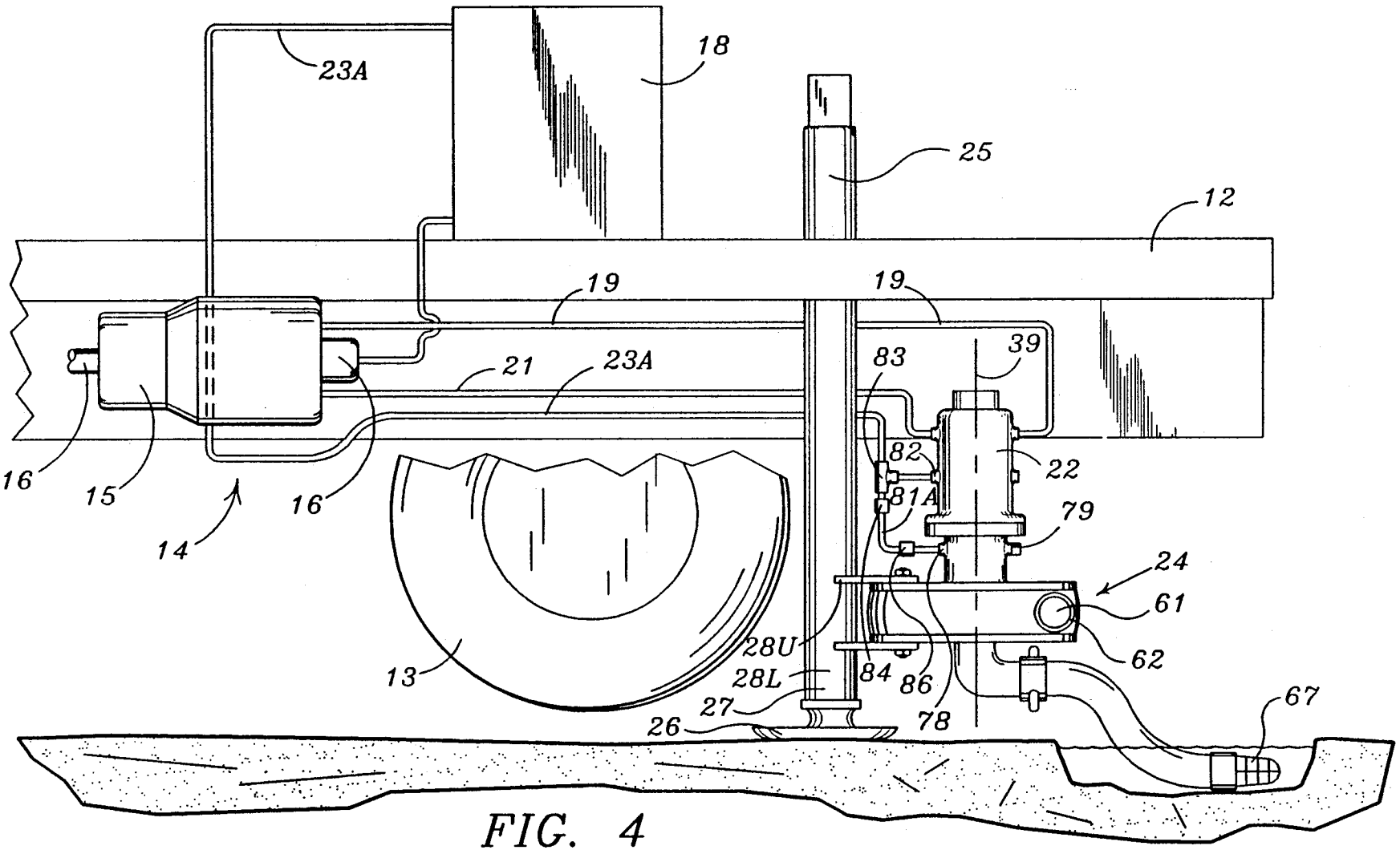
FIG. 4 is a view similar to FIG. 1 but showing an alternate hydraulic arrangement for bearing supply.

Referring now to FIG. 4, an embodiment is shown wherein the case drain fluid is not returned from the mud pump bearing cavity to the hydraulic pump 15. In this case, instead of running the hydraulic fluid through the case drain line 81 (typically ¾ inch flexible hose) to the mud pump bearing housing, there is a tee fitting 83 to which ½ inch return line 23A is connected to return case drain fluid to the hydraulic pump 15. But also at the tee 83, a case drain fluid supply line 81A is connected. This is a ¼ inch line to the threaded port 78 in the mud pump housing. A plug is installed in the port 79. A 1/64 inch orifice 84 is installed in the line 81A as is a reverse flow check valve 86. The check valve prevents flow of oil from the mud pump housing backward toward the tee fitting 83. The orifice 84 limits the flow through the line 81A so that, if there is any failure of the mud pump shaft seal assembly, the amount of oil which would escape through it into the mud pit or well will be very much restricted. In this way, maintenance of adequate hydraulic fluid in the pump-motor system is assured, and any significant loss through the mud pump assembly is avoided. At the same time, however, while the mud pump assembly is in good working condition and the seal intact, the case drain pressure from the hydraulic motor case 22 is applied and maintained in the mud pump bearing assembly.

With the present invention, the seal assembly will be protected from passage of muddy water through it, regardless of whether or not the desired periodic greasing through the fitting 77 is neglected. At such time as the seal assembly might begin to leak due to long term wear, any leakage through it would be hydraulic fluid from the bearing housing into the impeller cavity, not vice versa. Thus, the sealing surfaces would continue to be lubricated in contrast to the situation which occurs with conventional packing where, when a leak occurs, it is muddy water containing various abrasives which leaks through the seal assembly toward the bearings, resulting in increasingly rapid deterioration of the seal and the bearings.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. Pumping apparatus comprising:

a hydraulic motor having a case and power output member, the output member being driven by hydraulic fluid in a system wherein the hydraulic fluid is supplied under pressure to the motor;

a pump impeller coupled to the motor output member and drivable by the motor;

a bearing assembly supporting the impeller;

a bearing lubricator delivering a portion of the hydraulic fluid under pressure to the bearing assembly;

a pump housing assembly having a cavity therein receiving the bearing assembly and having a cavity therein receiving the impeller;

a seal separating the impeller cavity from the bearing cavity;

the pumping housing assembly being attached to the motor case; and the motor case being bolted directly to the pump housing assembly at the bearing cavity thereby closing the bearing cavity to contain hydraulic fluid under pressure in the bearing cavity.

2. The apparatus of claim 1 and wherein:

the hydraulic motor has a hydraulic supply inlet, a hydraulic return outlet and a case drain outlet;

the bearing lubricator includes a motor case drain passageway from the motor case drain outlet to the bearing assembly receiving cavity and entering the bearing assembly receiving cavity through a wall thereof at a point radially outward from the bearing assembly.

3. The apparatus of claim 2 and further comprising:

a return line from the bearing assembly cavity to the system to return case drain hydraulic fluid to the system.

4. The apparatus of claim 2 and further comprising:

means in the passageway to prevent movement of fluid in the passageway in a direction away from the bearing assembly cavity, and to restrict flow through the passageway into the cavity.

5. The apparatus of claim 4 and further comprising:

a motor case drain line returning fluid at motor case drain pressure form the motor case drain outlet into the system.

6. Pumping apparatus comprising:

a hydraulic motor having a case with a motor drive fluid supply inlet and return outlet and a case drain outlet and having a power output member;

a mud pump impeller coupled to the output member;

a bearing assembly between the motor and impeller and supporting the impeller; and a seal between the impeller and the bearing assembly to prevent fluids at the impeller from communicating with the bearing assembly;

the case drain outlet communicating with the bearing assembly and applying motor driving hydraulic fluid moved by case drain pressure and applying the fluid from the case drain outlet at case drain pressure in the bearing cavity and establishing a pressure drop across the seal from the bearing assembly side of the seal to the impeller side of the seal.

7. The apparatus of claim 6 and wherein the motor case has a mounting flange, the apparatus further comprising:

a pump housing around the impeller and bearing assembly and having a mounting flange bolted directly to the mounting flange of the motor case and having a bearing lubrication fluid inlet; and a case drain line coupled to the motor case drain outlet and to the lubrication fluid inlet and delivering the hydraulic fluid from the motor case to the bearing assembly.

8. The apparatus of claim 7 and wherein:

the lubrication fluid inlet is located radially outward from the bearing assembly.

9. The apparatus of claim 6 and further comprising:

a housing around the seal;

a shaft coupling the impeller to the motor output member;

the seal including a first ring fixed and sealed in the housing, and a second ring rotatable with the shaft and axially slidable on the shaft and sealed to the shaft, the first and second rings having abutting sealing surfaces providing a rotary seal.

10. The apparatus of claim 9 and further comprising:

a spring urging the first and second rings together at their abutting sealing surfaces.

11. The apparatus of claim 6 and further comprising:

a mud pump housing assembly including a pump shaft support portion, an impeller surrounding portion and an end cover, the housing assembly thereby enclosing the impeller and having a mud inlet in the cover and a mud outlet in the impeller surrounding portion, the pump shaft support portion being fastened to the motor case and cooperating with a portion of the motor case for enclosing the bearing assembly.

12. The apparatus of claim 11 and wherein:

the pump shaft support portion has motor mounting face and a bore communicating with the face and with the bearing assembly; and the motor case has a pump mounting face and a cylindrical boss at the face and fittingly received in the bore, the motor case being sealed to the bearing support portion to contain the hydraulic fluid in the bearing assembly.

13. The apparatus of claim 12 and wherein:

the mud inlet is in the center of the cover; and the mud outlet is in the perimeter of the impeller surrounding portion;

the apparatus further comprising a shaft having the impeller fastened to one end and having its other end coupled to the motor output member inside the bearing assembly.

* * * * *